US005400856A

United States Patent [19]

Schmidt

[11] Patent Number: 5,400,856

[45] Date of Patent: Mar. 28, 1995

[54] OVERPRESSURED FRACTURING OF DEVIATED WELLS

[75] Inventor: Joseph H. Schmidt, Anchorage, Ak.

[73] Assignee: Atlantic Richfield Company, Los Angeles, Calif.

[21] Appl. No.: 237,612

[22] Filed: May 3, 1994

[51] Int. Cl.[6] ..... E21B 43/26

[52] U.S. Cl. ..... 166/271; 166/297; 166/305.1; 166/308; 166/384; 166/77

[58] Field of Search ..... 166/77, 271, 297, 305.1, 166/308, 384

[56] References Cited

U.S. PATENT DOCUMENTS

| | | | |
|---|---|---|---|
| 2,740,478 | 4/1956 | Greene | 166/63 |
| 2,766,828 | 10/1956 | Rachford, Jr. | 166/36 |
| 3,170,517 | 2/1965 | Graham et al. | 166/42 |
| 3,190,357 | 6/1965 | Kirk | 166/44 |
| 3,200,882 | 8/1965 | Allen | 166/42 |
| 3,393,741 | 7/1968 | Huitt et al. | 166/42 |
| 3,401,749 | 9/1968 | Daniel | 166/46 |
| 3,727,690 | 4/1973 | Munson | 166/297 |
| 3,923,099 | 12/1975 | Brandon | 166/249 |
| 4,109,719 | 8/1978 | Martin et al. | 166/259 |
| 4,245,699 | 1/1981 | Steeman | 166/271 |
| 4,305,464 | 12/1981 | Masszi | 166/370 |
| 4,374,543 | 2/1983 | Richardson | 166/192 |
| 4,619,323 | 10/1986 | Gidley | 166/285 |
| 4,633,951 | 1/1987 | Hill et al. | 166/308 |
| 4,683,943 | 8/1987 | Hill et al. | 166/63 |
| 4,685,516 | 8/1987 | Smith et al. | 166/65.1 |
| 4,715,443 | 12/1987 | Gidley | 166/305.1 X |
| 4,718,493 | 1/1988 | Hill et al. | 166/308 |
| 4,823,875 | 4/1989 | Hill | 166/280 |
| 4,830,120 | 5/1989 | Stout | 175/4.51 |
| 4,877,089 | 10/1989 | Burns | 166/377 |
| 4,903,772 | 2/1990 | Johnson | 166/299 |
| 4,995,463 | 2/1991 | Kramm et al. | 166/308 |
| 5,000,264 | 3/1991 | Snider | 166/372 |
| 5,005,649 | 4/1991 | Smith et al. | 166/308 |
| 5,074,359 | 12/1991 | Schmidt | 166/280 |
| 5,103,911 | 4/1992 | Heijnen | 166/297 |
| 5,103,912 | 4/1992 | Flint | 166/297 |
| 5,131,472 | 7/1992 | Dees et al. | 166/308 |
| 5,147,111 | 9/1992 | Montgomery | 299/16 |
| 5,195,588 | 3/1993 | Dave | 166/255 |
| 5,199,766 | 4/1993 | Montgomery | 299/5 |
| 5,205,360 | 4/1993 | Price | 166/308 |
| 5,271,465 | 12/1993 | Schmidt et al. | 166/297 |
| 5,287,741 | 2/1994 | Schultz et al. | 166/298 X |
| 5,297,631 | 3/1994 | Gipson | 166/305.1 X |
| 5,353,875 | 10/1994 | Schultz et al. | 166/297 |
| 5,361,843 | 11/1994 | Shy et al. | 166/297 |

OTHER PUBLICATIONS

SPE 17581, "Coiled Tubing in Horizontal Wells", R. E. Cooper (1988).

SPE16894, "Perforating a High-Pressure Gas Well Overbalanced in Mud: Is It Really That Bad?", Bundy et al. (1987).

"The Multiwell Experiment—A Field Laboratory in Tight Gas Sandstone Reservoirs", Northrop et al., *JPT* (Jun. 1990).

"Hydraulic Fracturing in Tight, Fissured Media", Norman R. Warpinski, *JPT* (Feb. 1991).

SPE/DOE/GRI 12843, "Cavity Stress Relief Method To Stimulate Demethanation Boreholes" by A. K. Alain et al. (1984).

*Primary Examiner*—Roger J. Schoeppel

*Attorney, Agent, or Firm*—Dougherty, Hessin, Beavers & Gilbert

[57] ABSTRACT

Methods are provided for overpressured perforating and fracturing of a subsurface formation in a substantially deviated well. A perforating gun is run into the well and is pushed through the deviated portion thereof on a coiled tubing string. The coiled tubing string contains an internal supporting pressure which is high enough to prevent collapse of the coiled tubing string prior to perforation of the well and which is low enough to avoid rupturing the coiled tubing string. After the perforations are formed and the fractures are initiated, the supporting gas pressure in the coiled tubing string is bled off to the atmosphere and the coiled tubing string and perforating gun are retrieved.

20 Claims, 3 Drawing Sheets

OVERPRESSURED FRACTURING OF DEVIATED WELLS

BACKGROUND OF THE INVENTION

1. Field Of The Invention

The present invention pertains to a fracturing method for hydraulically fracturing an earth formation from a wellbore by overpressuring the wellbore with compressed gas so as to provide a high pressure flow condition during fracture initiation, and the invention particularly pertains to such methods which are suitable for use in deviated wells.

2. Description Of The Prior Art

In hydraulically fracturing earth formations to stimulate production of fluids therefrom, a long-standing problem has been the inability to sustain high pressure and flow of the fracturing fluid during fracture initiation. In deviated wells, in particular, inadequate pressure and flow conditions at the fracture initiation will produce multiple fractures and near wellbore kinks in the multiple fractures which will tend to restrict the flow of fluids to or from the wellbore once the fracture has been formed. U.S. Pat. No. 5,074,359 issued Dec. 24, 1991, to Joseph H. Schmidt and assigned to the assignee of the present invention discusses the problem of improper fracture formation from deviated wellbores, in particular. That patent is directed to a method for orienting the casing perforations to minimize improperly formed fractures at or near the perforations.

Conventional hydraulic fracturing is limited by the inability to provide the fracture fluid at sufficiently high initial flow rate and pressure to sustain the formation of a single slowly turning fracture. Since, in conventional fracturing techniques, the fracture fluid is supplied at the requisite pressure from surface disposed pumps, pressure losses through the pumping system and the wellbore conduits leading to the fracture zone often preclude adequate single fracture formation and extension during initial breakdown. The resultant pressure drop in the flow path in the improperly formed or inadequately extended fractures prevents or restricts the future ability to stimulate the formation with a hydraulic proppant frac.

One proposal which has been put forth to improve this situation is to overpressure the wellbore with compressed gas bearing on the fracturing fluid prior to formation of the perforations, so that immediately upon formation of the perforations, the expanding gas will force the fracturing fluid into the formation at or above formation breakdown pressure at a sustained flow rate for a sufficient time to provide a reduced number of fractures which will not pinch off or be kinked in the near wellbore region. Such techniques are suggested in U.S. Pat. No. 3,170,517 to Graham, U.S. Pat. No. 5,131,472 to Dees et al., and U.S. Pat. No. 5,271,465 to Schmidt et al.

Graham et al. and Schmidt et al. disclose the use of a wireline conveyed perforating gun. Dees et al. discloses alternatively the use of a tubing conveyed perforating gun disposed on the production tubing itself or the use of a wireline conveyed perforating gun.

Neither of these alternatives is desirable for use in deviated wells, especially where it is desired not to leave the perforating gun in the well after perforating. The wireline conveyed perforating gun cannot be run through deviated portions of a well which have such a significant horizontal component that gravity alone cannot pull the perforating gun down through the wellbore. Although a tubing conveyed perforating gun as suggested in Dees et al. could be run into a horizontal well, the perforating gun cannot be removed therefrom without pulling the entire production tubing string which is of course undesirable. Furthermore, if the perforating gun is of the type which is dropped upon firing, it could not be reliably dropped to the bottom of the borehole since it would likely remain in the deviated borehole portion.

As explained below, the present invention solves this problem with perforating methods which involve the use of a coiled tubing-string for running the perforating gun down through a production tubing string or through a casing. Unique techniques are provided for assuring the operability and integrity of the coiled tubing string in the unique environment in which it must operate, namely the extremely high pressure environment surrounding the coiled tubing prior to perforation.

Although the prior art does also include the use of coiled tubing conveyed tools in deviated boreholes such as shown for example in U.S. Pat. No. 3,401,749 to Daniel and U.S. Pat. No. 4,877,089 to Burns, the prior art has not previously shown or suggested methods for using such a system in the unique high pressure environment encountered in overpressured fracturing.

SUMMARY OF THE INVENTION

A method is provided for initiating a fracture in a subsurface formation intersected by a wellbore. The subsurface formation has a fracture breakdown pressure. The wellbore includes a deviated wellbore portion and a space defined in part by a casing. A production tubing string extends within the casing and opens into the space. The production tubing string is operably associated with a wellhead.

The method includes steps of running a perforating gun on a coiled tubing string down into an interior of the production tubing string.

The interior of the coiled tubing string is isolated from the interior of the production tubing string so that there is no pressure communication therebetween.

The coiled tubing string is .used to push the perforating gun through the production tubing string and particularly through those portions of the production tubing string contained within the deviated wellbore portion through which the perforating gun could not fall by mere gravity conveyance if it was conveyed on a wireline. The coiled tubing string pushes the perforating gun out the lower end of the production tubing string into the space to a downhole position adjacent the subsurface formation which is to be perforated.

The space is at least partially filled with fluid. As further described below, this fluid may be provided in several ways.

Then, a pressure gas is introduced into the interior of the production tubing string between the space and the wellhead.

The pressure of this pressure gas is increased a predetermined amount sufficient to force fluid into the subsurface formation from the space at a pressure which exceeds the fracture breakdown pressure of the subsurface formation. This pressure increase can be accomplished either by introducing compressed gas into the production tubing or by introducing additional liquid into the production tubing to further compress the gas which is already present.

To prevent inward collapse of the coiled tubing string due to the high external pressures present in the production tubing string, a supporting fluid pressure is provided within the interior of the coiled tubing string sufficient to prevent such a collapse. The supporting fluid pressure preferably is provided by filling the coiled tubing with a pressurized supporting liquid such as water.

It is also important that the supporting pressure be sufficiently low that it will not rupture the portion of the coiled tubing string extending out of the well which is exposed to atmospheric pressure on its exterior.

Then the perforating gun can be actuated, thus perforating the casing to communicate the subsurface formation with the space. In a first embodiment, the perforating gun is an electrically fired gun which is actuated by sending an electrical signal down an electric line extending through the coiled tubing string. In a second embodiment, the perforating gun is pressure actuated by increasing fluid pressure in the coiled tubing string.

The liquid contained in the space then immediately flows through the perforations into the subsurface formation under the pressure of the expanding pressure gas in the production tubing string. This initiates fractures in the subsurface formation extending outward from the perforations and this is accomplished immediately after perforating of the casing.

After the well is perforated, the supporting pressure within the interior of the coiled tubing string is vented to atmospheric pressure at the earth's surface and the coiled tubing string and perforating gun can be retrieved.

It is noted that although the embodiment shown in FIG. 1 of Dees et al. U.S. Pat. No. 5,131,472 does utilize tubing conveyed perforating guns, that device does not use a coiled tubing string. In the Dees et al. patent, the tubing is conventional rigid tubing which in fact contains the high pressure fluids which are to be used to fracture the well. Substantially simultaneously with the actuation of the perforating guns, the tubing of Dees et al. is vented into the well space so as to allow the high pressure fluid from within the tubing to flow into the well space and through the perforations to fracture the well. In the present application, the coiled tubing string does not carry fracturing fluids and the pressure within the coiled tubing string is never communicated with the fracturing fluids. The coiled tubing string of the present invention is pressurized only to prevent collapse thereof or for the purpose of firing a pressure actuated perforating gun, and that pressure is subsequently vented to the atmosphere, not to the production tubing string or the casing.

Also, the system of the present invention does not provide in any manner for the supplying of additional pressurized fluids to further extend the fracture, other than those fluids which are provided in the production tubing string prior to perforation. This, too, is contrasted to systems like that of Dees et al., wherein substantially immediately after perforation additional liquids are pumped into the well to further propagate the fractures before they close. With the present invention, the fractures are allowed to close as soon as the initial hydraulic overpressure has bled off into the formation. If any further conventional fracturing is carried out, this occurs at a much later time after the coiled tubing string and perforating gun have been removed from the well.

Accordingly, it is an object of the present invention to provide methods for overbalanced perforating of deviated wells.

Another object of the present invention is to provide methods of overbalanced perforating of wells utilizing a coiled tubing conveyed perforating gun, which methods prevent collapse of the coiled tubing due to the overpressure condition existent in the well.

Still another object of the present invention is to provide methods of overpressured fracturing of wells utilizing a coiled tubing conveyed perforating gun wherein rupture of the coiled tubing is prevented.

Numerous other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
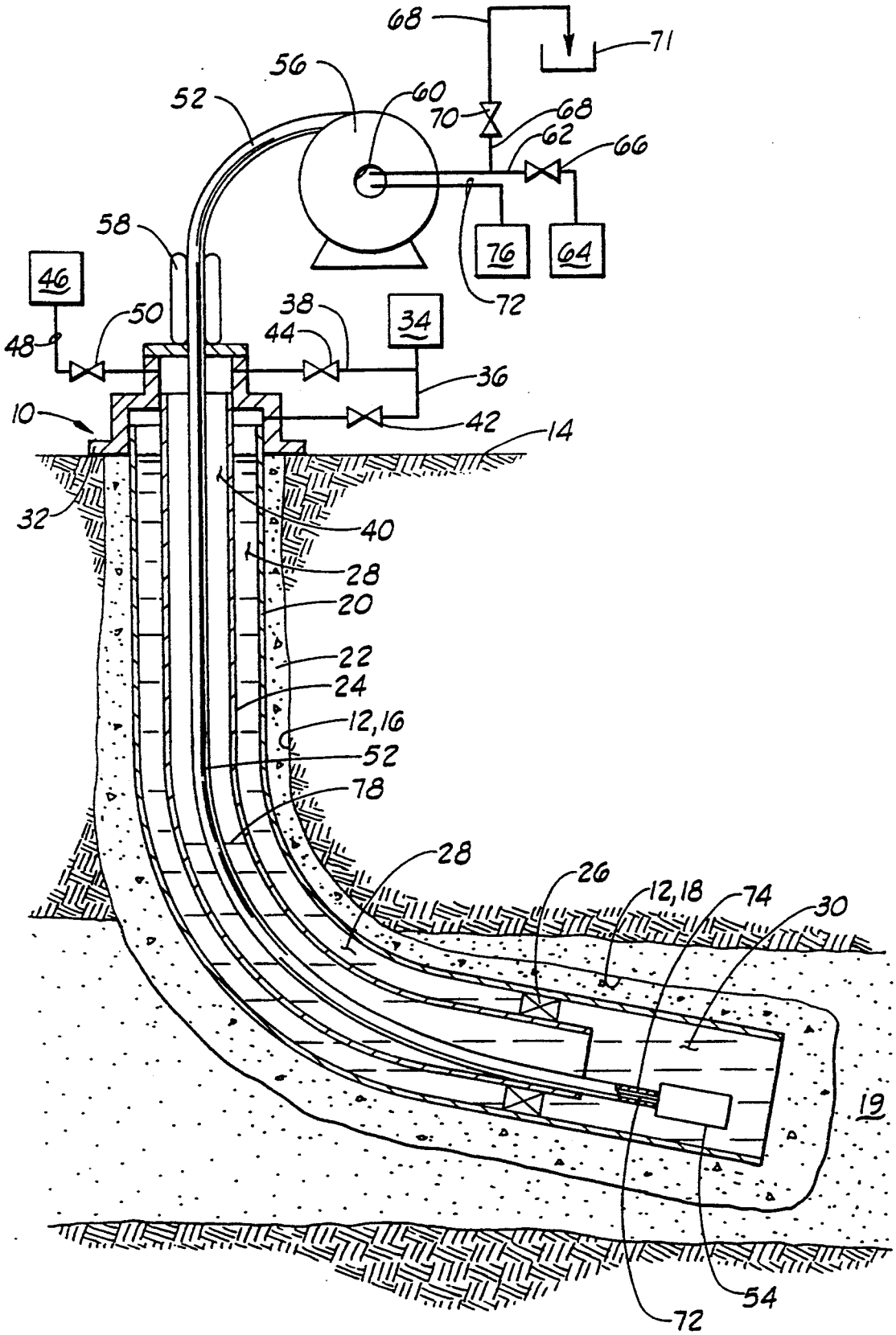
FIG. 1 is a schematic elevation sectioned view of a deviated well having a coiled tubing conveyed perforating gun in place therein. The well is shown in a condition prior to pressurizing the gas contained in the production tubing string.

Referring now to the drawings, and particularly to FIG. 1, a well is shown and generally designated by the numeral 10. The well 10 is formed by a wellbore 12 extending downward from the earth's surface 14.

The wellbore 12 has a substantially vertical portion 16, and a substantially deviated or horizontal portion 18. The horizontal wellbore portion 18 intersects a subsurface formation 19 of interest which is to be perforated and fractured. Although the present invention is intended primarily for use in deviated wells, it will be appreciated that certain aspects of the invention will also have application to non-deviated wells where the greater load carrying capacity of coiled tubing will provide an advantage as compared to wireline conveyed perforating-guns.

A well casing 20 is cemented in place within the borehole 12 by cement 22.

A production tubing string 24 is concentrically received within the well casing 20 and a conventional packer 26 seals between the production tubing string 24 and casing 20 near the lower end thereof. Although the invention is illustrated and described herein in the context of a well having production tubing received within the casing, it will be appreciated that the presence of the production tubing is not required for use of the present invention. Each technique provides different advantages. For example, when production tubing is used, pressure can be applied to the annulus between the production tubing and casing so that higher surface pressures can be achieved. On the other hand, the volumes used in casing without production tubing are much larger and pressure reduction associated with fluid flow is less in the bigger casing. Engineering dictates which is the preferable technique to use.

The packer 26 separates the bore of casing string 20 into a well annulus 28 located thereabove and a well space 30 located therebelow. The space 30 is located adjacent the subsurface formation 19 which is to be perforated and fractured.

At the top of the well 10 a conventional wellhead 32 closes the upper ends of the casing string 20 and production tubing string 24 and provides means of communication therewith.

A compressor 34 is located at the earth's surface and is communicated by compressed gas supply lines 36 and 38 with the well annulus 28 and with the interior 40 of the production tubing string 24, respectively. Valves 42 and 44 are disposed in gas supply lines 36 and 38, respectively.

A pump 46 may provide liquid through a liquid supply line 48 to the interior 40 of production tubing string 24. Supply line 48 has a valve 50 therein.

A coiled tubing string 52 is shown in place within the production tubing string 24. The coiled tubing string 52 carries a perforating gun 54 on its lower end. As previously noted, the perforating gun 54 may be either an electrically actuated gun or a pressure actuated gun. The coiled tubing string 52 is dispensed from a coiled tubing reel 56 through a coiled tubing injector 58 mounted on top of the wellhead 32.

At a central hub 60 of coiled tubing reel 56, a support fluid supply line 62 is communicated with the interior of coiled tubing string 52. The support fluid supply line 62 preferably provides liquid to the coiled tubing interior from a pump 64 to provide supporting pressure and also to activate the perforating gun when a pressure actuated firing head is used. Thus, supply line 62 can also be described as a support liquid supply line 62. Supply line 62 has a valve 66 disposed therein. A vent line 68 branches off supply line 62 and has a vent valve 70 therein for allowing supporting liquid pressure from the interior of coiled tubing string 52 to be vented to a slop tank 71 at atmospheric pressure in a manner further described below.

Alternatively, if an electrically fired perforating gun is used, the coiled tubing could be pressurized with a gas through the support fluid supply line 62. In that case, pump 64 would be replaced with a compressor.

When the perforating gun 54 is electrically actuated, an electric line 72 is connected at its lower end to the electrically actuated perforating gun 54. The electric line 72 runs through the interior or bore 74 of coiled tubing string 52 and exits at hub 60. Electric line 72 is connected with a control station 76 located at the earth's surface.

Manner Of Operation

The system illustrated in FIG. 1 is utilized for overbalanced perforating of deviated wells in the following manner.

First, the perforating gun 54 is run on the coiled tubing string 52 down into the interior 40 of production tubing string 24.

It is noted that the interior or bore 74 of coiled tubing string 52 is isolated from the interior 40 of production tubing string 24 so that there is no pressure communication therebetween.

The coiled tubing string 52 due to its structural rigidity can be used to push the perforating gun 54 through the production tubing string 24 and particularly through the lower portion thereof received within the deviated wellbore portion 18. The coiled tubing string 52 is used to push the perforating gun 54 out the lower end of production tubing string 24 into the well space 30 adjacent the subsurface formation 19 as is generally illustrated in FIG. 1.

The space 30 is provided at least partially filled with liquid as illustrated in FIG. 1. This liquid may come from any one of several sources. It may be liquid which was already present in the wellbore when .the production tubing string 24 was placed therein, or it may be injected into the well with pump 46. In the example illustrated in FIG. 1, this liquid has an upper liquid level 78.

A pressure gas, which may be any suitable gas such as air or nitrogen, is introduced into the interior 40 of production tubing string 24 between the space 30 and the wellhead 32, i.e., above the upper level 78. This gas may simply be air which is present in the production tubing string 24 or it may be additional air or other gas such as methane or nitrogen which is purposely injected by compressor 34 into the production tubing string 24 through supply line 38.

Next, the pressure of the gas in production tubing string 24 must be raised a predetermined amount sufficient to force the liquid from space 30 into the subsurface formation 19 to fracture the formation 19. Thus, the pressure of the gas and of the liquid must be above the fracture breakdown pressure of the subsurface formation 19.

This pressure increase can be applied to the gas and liquid in the production tubing string 24 in any number of ways. Several such techniques are disclosed in U.S. Pat. No. 5,271,465 of Schmidt et al., and assigned to the assignee of the present invention, the details of which are incorporated herein by reference.. There are generally two preferred such techniques for increasing the pressure of the gas in production tubing string 24. The first of these is to introduce additional compressed gas into production tubing string 24 with the compressor 34 through compressed gas supply line 38. The second technique is to pump additional liquid into the interior of production tubing string 24 with pump 46 through supply line 48. Also, if necessary, part of the liquid present in the conduit may first be removed by swabbing or by gas displacement as described in the aforesaid copending application.

Figure 2:
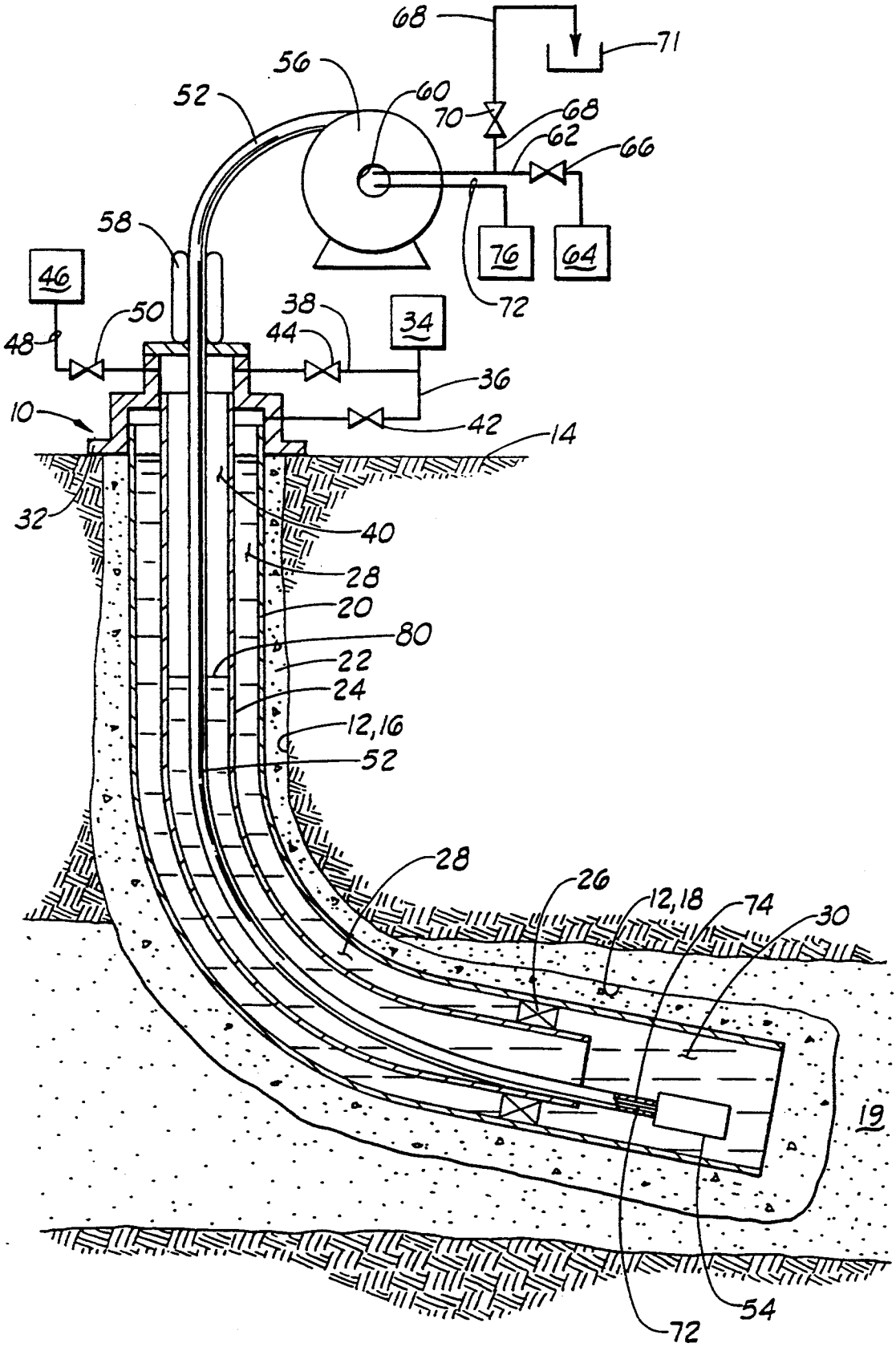
FIG. 2 is a view similar to FIG. 1 illustrating the fluid levels in the well after additional fluid has been added to the production tubing string to pressurize the gas contained in the production tubing string, prior to perforation of the well.

FIG. 2 illustrates the second mentioned technique wherein the pressure within the production tubing string 24 has been increased by pumping additional liquid into production tubing string 24 thus raising the upper level of liquid therein to the level 80 indicated in FIG. 2.

Also, if desired, lead fluids such as acids or crosslinked fracturing fluids may be spotted in the well space prior to perforating the well as described in the aforesaid U. S. Pat. No. 5,271,465 which is incorporated herein by reference.

In general, prior to perforation the liquid volume and gas pressure within the production tubing string should be such that a gas accumulation is formed with a sufficient volume of fracturing fluid available in the well space to be propelled through the perforations with sufficient pressure to exceed the formation breakdown pressure by an amount which will provide a suitable fracture. In this way, the fracture may be formed and extended without concern for fluid pressure losses which would be incurred in conventional fracturing operations where the fracture fluid is pumped all the way from the surface through the entire length of the production tubing string.

Very substantial pressures may be applied to the fluids within production tubing string 24. For example, pressures on the order of 6,000 to 9,000 psi may be present therein. In order to avoid collapsing the coiled tubing string 52 when it is exposed to such high pressures, a supporting liquid pressure is provided in the coiled tubing bore 74 by introducing the same with pump 64 through supporting liquid supply line 62. The supporting liquid pressure contained within the coiled tubing string 52 will typically not be as high as the pressure within production tubing string 24, but it will be sufficiently high that the structural strength of the coiled tubing string 52 can support the inward pressure differential which still exists thereacross. As further explained below, however, it is important that this supporting liquid pressure within coiled tubing string 52 not be too high, because if it were, it could rupture the portion of the coiled tubing string 52 extending above the wellhead which is exposed to atmospheric pressure on its exterior. This rupture could be an actual rupture of the wall of the coiled tubing or it could be a failure of a connection on the coiled tubing reel. Thus, for any given selected coiled tubing string and given well environment, there will be a range within which the supporting liquid pressure in coiled tubing string 52 must be maintained so as to be sufficiently high to prevent collapse of the coiled tubing string prior to perforation, and to be sufficiently low to avoid rupture of the coiled tubing string. In one example described later in this specification, that range is from about 1000 psi to about 4500 psi at the elevation of the ground level 14.

It is noted that the critical point of possible collapse of coiled tubing string 52 is just below the wellhead; there the inwardly directed pressure differential is at its maximum. At lower elevations, the increase in internal pressure due to the liquid head in coiled tubing string 52 will be greater than the increase in external pressure due to the gas head in the production tubing, thereby decreasing the inwardly directed pressure differential.

Figure 3:
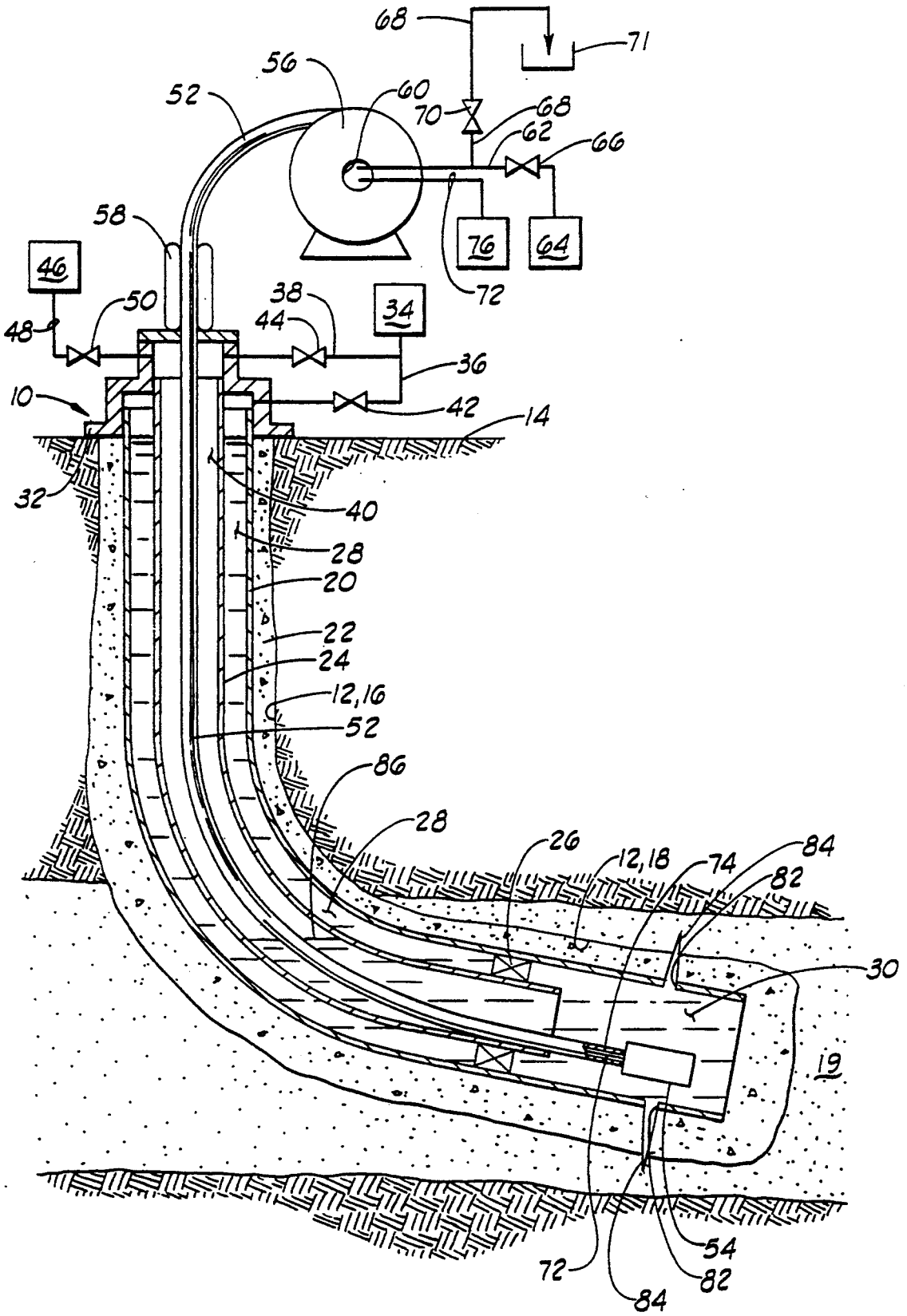
FIG. 3 is a view similar to FIG. 1 after the well has been perforated and the gas in the production tubing string has expanded to force the liquid in the production tubing string through the perforations to fracture the well.

Once the perforating gun 54 has been positioned as shown in FIG. 1 and the pressure in production tubing string 54 has been raised to above the fracture breakdown pressure of the formation 19 as illustrated in FIG. 2, the well is ready to be perforated and fractured. This is accomplished by actuating the perforating gun 54 either by sending an electrical command signal from the surface control station 76 down electric line 72 to an electrically fired perforating gun 54 or by increasing coiled tubing interior pressure for a pressure actuated perforating gun. Upon firing of the perforating gun 54, perforations 82 are formed through casing 20 and cement 22 as schematically illustrated in FIG. 3.

Immediately upon formation of the perforations 82, the high pressures contained in production tubing string 24 will cause the liquid contained in space 30 to flow through the perforations 82 into the subsurface formation 19 under pressure of the expanding gas in the production tubing string 24 thereby creating fractures 84 extending from the perforations 82.

As soon as the pressure of the gas contained in production tubing string 24 has dropped below the formation breakdown pressure of formation 19, the fractures 84 will close and fluid flow through perforations 82 will stop. The level of the liquid within the production tubing string 24 will then be at a lower level such as schematically represented by level 86 shown in FIG. 3. There is no immediate introduction of further fracturing liquid into the production tubing string 24 from pump 46. The fractures 84 will have been propagated a sufficient distance away from the near wellbore region so that if further fracturing is necessary, it can be done with a conventional fracturing operation at a much later time. Typically, at least twenty-four hours or more will be allowed to pass before a conventional fracturing operation would be performed to further extend the fractures 84.

After the well has been fractured as just described, the supporting liquid pressure contained in coiled tubing string 52 is vented to a low pressure zone other than the production tubing string 24 or space 30. Preferably, the supporting gas pressure in coiled tubing string 52 is vented to slop tank 71 at atmospheric pressure through atmospheric vent line 68 and valve 70. The coiled tubing string is not vented to the production tubing string or casing or otherwise used as a source of high pressure gas for fracturing purposes. The coiled tubing string 52 and perforating gun 54 may then be retrieved with the coiled tubing reel 56.

After the coiled tubing string has been removed from the well conventional fracturing stimulation can be carried out to reopen the fractures 84 and expand or prop them as desired.

EXAMPLE

A typical well on the North Slope of Alaska is drilled to a vertical depth of 8900 FT., corresponding to a measured well depth along the well bore of 11,000 FT. At the bottom of the hole, the formation breakdown pressure is 7,800 psi; the fracture pressure is 5,600 psi, and the formation pressure is 3,900 psi. The coiled tubing string is QT800, ¾-inch diameter, 0.175-inch wall thickness, which is rated for 11,000 psi collapse and 19,690 psi burst. Actual operating limits used for this coiled tubing are 7,000 psi collapse and 4,500 psi burst. The 7,000 psi collapse operating limit is chosen as a safety factor to allow for reduced strength of the tubing due to working and due to tensile loading. The 4,500 psi burst operating limit is chosen due to operating limits of connectors on the coiled tubing reel. The gas pressure applied at the upper end of production tubing/coiled tubing annulus 40 is 8,000 psi, which corresponds to a fluid pressure in space 30 adjacent formation 19 of 10,900 psi. The supporting fluid pressure in coiled tubing string 52 at ground elevation 14 is preferably 4,000 psi, and is within the range of from about 1,000 psi to about 4,500 psi. The 1,000 psi lower limit on the supporting fluid pressure range insures that the collapse loading due to the 8,000 psi external pressure in annulus 40 at ground level will not exceed the 7,000 psi operating collapse limit for the coiled tubing. The 4,500 psi upper limit on the supporting fluid pressure range insures that excessive bursting pressure will not be placed on the connectors on the coiled tubing reel.

Thus it is seen that the methods of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. A method for forming a fracture in a subsurface formation intersected by a well, said subsurface formation having a fracture breakdown pressure, said well including a casing defining a lower well space of said well, said casing being operably connected to a wellhead, said method comprising the steps of:

(a) running a perforating gun on a coiled tubing string down into said lower well space to a position adjacent said subsurface formation which is to be perforated;

(b) isolating an interior of said coiled tubing string from said well;

(c) providing said space at least partially filled with liquid;

(d) providing pressure gas in said well between said space and said wellhead;

(e) increasing the pressure of said pressure gas a predetermined amount sufficient to force liquid into said subsurface formation from said space at a pressure which exceeds said fracture breakdown pressure of said subsurface formation;

(f) providing a supporting fluid pressure within said interior of said coiled tubing string sufficient to prevent said coiled tubing string from collapsing due to said pressure of said pressure gas in said well;

(g) actuating said perforating gun and forming perforations perforating said casing and communicating said subsurface formation with said space; and (h) flowing said liquid from said space through said perforations into said subsurface formation under the pressure of said pressure gas in said well and thereby creating a fracture in said subsurface formation immediately after perforating said casing.

2. The method of claim 1, wherein:

step (f) includes, during steps (g) and (h), maintaining said supporting fluid pressure at a level below a pressure which would rupture said coiled tubing string.

3. The method of claim 1, further comprising:

after step (h), venting said supporting fluid pressure from said interior of said coiled tubing string to a low pressure zone other than said well.

4. The method of claim 1, further comprising:

after step (h), venting said supporting fluid pressure from said interior of said coiled tubing string to atmospheric pressure at the earth's surface.

5. The method of claim 1, wherein:

in step (a), said perforating gun is an electrically actuated perforating gun connected to a control station at the earth's surface by an electric line running through said interior of said coiled tubing string; and step (g) includes actuating said perforating gun by sending an electrical signal from said control station down said electric line to said perforating gun.

6. The method of claim 1, wherein:

in step (a), said perforating gun is a pressure actuated perforating gun; and step (g) includes actuating said perforating gun by increasing said supporting fluid pressure within said interior of said coiled tubing string.

7. The method of claim 1, further comprising:

after step (h), avoiding introduction of additional fluid into said well for sufficient time to allow said fracture formed in step (h) to close as soon as the pressure in said well bleeds off into said subsurface formation to a value below said formation breakdown pressure.

8. The method of claim 1, wherein:

step (e) includes increasing the pressure of said pressure gas by introducing compressed pressure gas into said well.

9. The method of claim 1, wherein:

step (e) includes increasing the pressure of said pressure gas by pumping additional liquid into said well and thereby further compressing pressure gas already present in said well.

10. The method of claim 1, said well including a production tubing string extending within said casing and opening into said space, wherein:

step (a) includes running said coiled tubing string and perforating gun down through said production tubing string until said perforating gun extends out of said production tubing string into said space;

step (b) includes isolating said interior of said coiled tubing string from said production tubing string; and step (d) includes providing said pressure gas in said production tubing string.

11. The method of claim 1, said well including a deviated well portion, wherein:

step (a) includes pushing said perforating gun with said coiled tubing string through the deviated well portion.

12. A method of perforating a subsurface formation intersected by a well and initiating fractures in said subsurface formation, said well including a wellbore, a well casing located in said wellbore, a production tubing string received in said well casing and a packer sealing between said production tubing string and said well casing above said subsurface formation to form a well annulus above said packer and a lower well space below said packer, said method comprising:

(a) running a coiled tubing string including a perforating gun down through said production tubing string and positioning said perforating gun adjacent said subsurface formation;

(b) providing a fracturing fluid in said lower well space adjacent said subsurface formation;

(c) providing a pressurized compressible gas in said production tubing string above said fracturing fluid so that the pressure of said compressible gas is communicated to said fracturing fluid and said fracturing fluid is thereby pressurized to a pressure above a fracture breakdown pressure of said subsurface formation;

(d) during step (c), maintaining a pressure in said coiled tubing string high enough to prevent collapse of said coiled tubing string due to the pressure in said production tubing string and low enough to avoid rupturing said coiled tubing string;

(e) isolating the pressure in said coiled tubing string from the pressure in said production tubing string;

(f) after step (c), firing said perforating gun and thereby forming perforations through said casing and into said subsurface formation; and (g) expanding said pressurized compressible gas and thereby forcing said fracturing fluid into said perforations and initiating fractures from said perforations into said subsurface formation.

13. The method of claim 12, said well having a deviated portion through which said perforating gun cannot fall by the pull of gravity alone, wherein:

step (a) includes pushing said perforating gun with said coiled tubing string through said deviated portion of said well.

14. The method of claim 12, further comprising:

after step (g), venting said pressure in said coiled tubing string to a low pressure zone other than said production tubing string.

15. The method of claim 12, further comprising:

after step (g), venting said pressure in said coiled tubing string to atmospheric pressure at the earth's surface.

16. The method of claim 12, wherein:

in step (a), said perforating gun is an electrically acutated perforating gun connected to a control station at the earth's surface by an electric line received through said coiled tubing string; and step (f) includes firing said perforating gun in response to an electrical signal transmitted from said control station.

17. The method of claim 12, further comprising:

after step (g), allowing said fractures to close as soon as said pressure of said compressible gas has bled off into said formation without introducing any additional fluid into said well.

18. The method of claim 12, wherein:

step (c) includes introducing precompressed gas into said production tubing string with a gas compressor.

19. The method of claim 12, wherein:

step (c) includes raising the pressure of compressible gas while said gas is present in said production tubing string by pumping additional liquid into said production tubing string.

20. A method of perforating a subsurface formation of a well and initiating fractures in said subsurface formation, said well having a deviated well portion and including a wellbore and a well casing located in said wellbore, said method comprising:

(a) providing a coiled tubing string including a tubing conveyed perforating gun and an electric line contained in said coiled tubing string and connecting said perforating gun to a command station at the earth's surface, said coiled tubing string having a coiled tubing bore isolated from said well;

(b) providing a fracturing fluid in said well casing adjacent said subsurface formation;

(c) running said coiled tubing string into said well and pushing said perforating gun through said deviated well portion;

(d) positioning said perforating gun in said fracturing fluid adjacent said subsurface formation;

(e) providing a pressurized compressible gas in said well above said fracturing fluid so that the pressure of said compressible gas is communicated to said fracturing fluid and said fracturing fluid is thereby pressurized to a pressure above a fracture breakdown pressure of said subsurface formation;

(f) during step (e), providing a supporting fluid pressure in said coiled tubing bore high enough to prevent collapse of said coiled tubing string due to the pressure in said well, and low enough to avoid rupturing said coiled tubing string;

(g) after step (e), sending an electrical signal from said command station through said electric line to fire said perforating gun and thereby forming perforations through said casing and into said subsurface formation;

(h) expanding said pressurized compressible gas and thereby forcing said fracturing fluid into said perforations and initiating said fractures from said perforations into said subsurface formation;

(i) allowing said fractures to close as soon as sufficient pressure has bled off from said well into said formation without introducing any additional fluid into said well; and (j) after step (i), venting said supporting fluid pressure in said coiled tubing string to a low pressure zone other than said well.

* * * * *